US009307336B2

(12) United States Patent
Wang et al.

(10) Patent No.: US 9,307,336 B2
(45) Date of Patent: Apr. 5, 2016

(54) ELECTRONIC DEVICE AND AUDIO OUTPUT CIRCUIT THEREIN

(71) Applicants: HONG FU JIN PRECISION INDUSTRY (ShenZhen) CO., LTD., Shenzhen (CN); HON HAI PRECISION INDUSTRY CO., LTD., New Taipei (TW)

(72) Inventors: Ya-Guo Wang, Shenzhen (CN); Chun-Ching Chen, New Taipei (TW)

(73) Assignee: ScienBiziP Consulting(Shenzhen) Co., Ltd., Shenzhen (CN)

( * ) Notice: Subject to any disclaimer, the term of this patent is extended or adjusted under 35 U.S.C. 154(b) by 59 days.

(21) Appl. No.: 14/445,304

(22) Filed: Jul. 29, 2014

(65) Prior Publication Data

US 2015/0030177 A1 Jan. 29, 2015

(30) Foreign Application Priority Data

Jul. 29, 2013 (CN) ..... 2013 1 0323950

(51) Int. Cl.
*H04R 1/10* (2006.01)
*H04R 29/00* (2006.01)
*H04R 5/033* (2006.01)

(52) U.S. Cl.
CPC ..... *H04R 29/001* (2013.01); *H04R 1/10* (2013.01); *H04R 5/033* (2013.01); *H04R 2420/05* (2013.01)

(58) Field of Classification Search
CPC ..... H04R 5/033; H04R 1/1041
USPC ..... 381/74
See application file for complete search history.

(56) References Cited

U.S. PATENT DOCUMENTS

| | | | | |
|---|---|---|---|---|
| 6,118,878 | A * | 9/2000 | Jones | G10K 11/178 381/71.11 |
| 6,738,603 | B1 * | 5/2004 | Saito | H01Q 1/244 333/124 |
| 6,751,316 | B1 * | 6/2004 | Gligoric | H03K 17/16 379/421 |
| 2008/0139042 | A1 * | 6/2008 | Liang | H04R 5/04 439/489 |
| 2012/0290742 | A1 * | 11/2012 | Sun | H01R 13/6658 710/11 |
| 2013/0142350 | A1 * | 6/2013 | Larsen | H04R 1/1041 381/74 |

* cited by examiner

*Primary Examiner* — Simon King
(74) *Attorney, Agent, or Firm* — Novak Druce Connolly Bove + Quigg LLP

(57) ABSTRACT

An audio output circuit applied in an electronic device includes a filter capacitor and a transistor. A base of the transistor is connected to an audio processing unit, an emitter of the transistor is connected to a voltage port, a processor and an earphone detecting unit of the electronic device is electrically connected to a collector of the transistor. The filter capacitor is connected between the base of the transistor and the ground. The filter capacitor filters the audio signals generated by the audio processing unit, to ensure that and the transistor is always turned on.

8 Claims, 1 Drawing Sheet

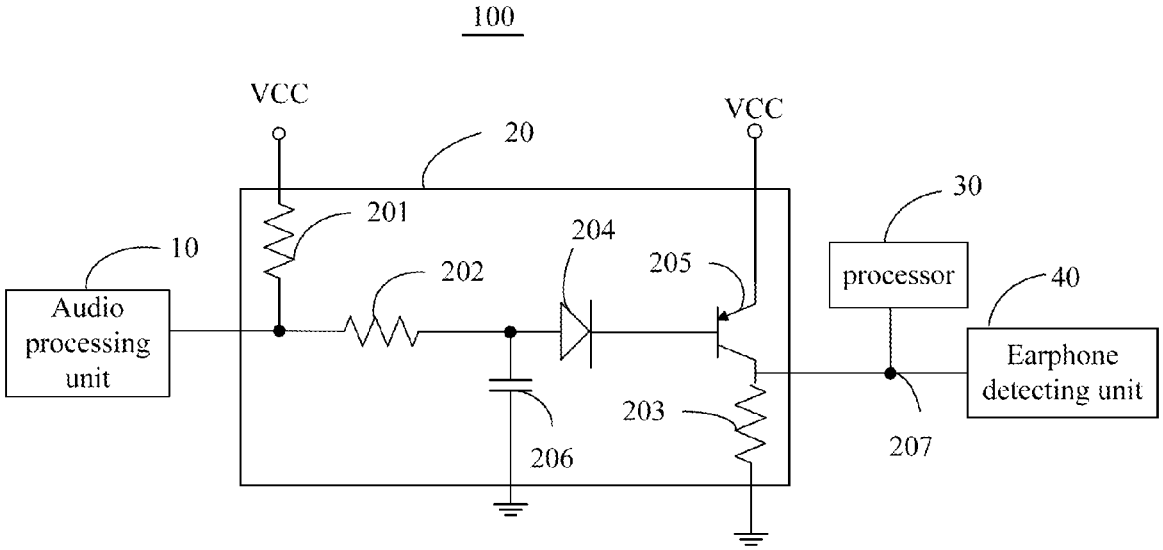
100
VCC
VCC
20
201
204
205
30
10
202
processor
40
Audio processing unit
Earphone detecting unit
203
206
207

ELECTRONIC DEVICE AND AUDIO OUTPUT CIRCUIT THEREIN

CROSS-REFERENCE TO RELATED APPLICATIONS

This application claims priority to Chinese Patent Application No. 201310323950.3 filed on Jul. 29, 2013 in China Intellectual Property Office, the contents of which are incorporated by reference herein.

FIELD

The subject matter herein generally relates to audio output circuits.

BACKGROUND

Audio output circuits are commonly used in electronic devices, for example, DVD players. Higher quality of audio outputted by the audio output circuits is desirable.

BRIEF DESCRIPTION OF THE DRAWINGS

Implementations of the present technology will now be described, by way of example only, with reference to the attached FIGURE.

The FIGURE is a circuit diagram illustrating an example embodiment of an audio output circuit in an electronic device.

DETAILED DESCRIPTION

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein, However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein.

Several definitions that apply throughout disclosure will now be presented. The term "coupled" is defined as connected, whether directly or indirectly through intervening components, and is not necessarily limited to physical connections. The connection can be such that the objects are permanently connected or releasably connected. The term "comprising" means "including, but not necessarily limited to", it specifically indicates open-ended inclusion or membership in a so-described combination, group, series and the like.

The feature illustrates a circuit diagram of an electronic device 100. The electronic device 100 includes an audio processing unit 10, an audio output circuit 20, a processor 30, and an earphone detecting unit 40. In this embodiment, the audio processing unit 10 can generate audio signals with different frequencies and different voltages, using an well known technology. The audio output circuit 20 is configured to output the audio signals generated by the audio processing unit 10 to a loudspeaker (not shown) or to an earphone (not shown).

The audio output circuit 20 can include a first resistor 201, a second resistor 202, a third resistor 203, a diode 204, a transistor 205, and a filter capacitor 206.

One end of the first resistor 201 is electrically connected to a voltage port VCC, another end of the first resistor 201 is electrically connected to the audio processing unit 10. In this embodiment, the voltage source VCC provides a voltage in 3.3V. The second resistor 202 is electrically connected between the audio processing unit 10 and an anode of the diode 204. A cathode of the diode 204 is connected to a base of the transistor 205. An emitter of the transistor 205 is connected to the voltage port VCC. A collector of the transistor 205 is electrically connected to the processor 30 and the earphone detecting unit 40. A connection node 207 is formed between the collector of the transistor 205, the processor 30, and the earphone detecting unit 40 and is coupled to all of the transistor 205, the processor 30, and the earphone detecting unit 40. The third resistor 203 is connected between the collector of the transistor 205 and the ground. The filter capacitor 206 is connected between the base of the transistor 205 and the ground. The voltage port VCC can couple to a battery (not shown) of the electronic device 100 to obtain a digital-high voltage (such as, 3.3 volts), and provides the high voltage to the emitter of the transistor 205.

When the earphone detecting unit 40 detects that an earphone is inserted into the electronic device 100, the earphone detecting unit 40 generates a digital-low voltage, thus, the voltage of the connection point 207 equals to the digital-low voltage. In this embodiment, the earphone detecting unit 40 can detect whether the earphone is inserted into the electronic device using a well known technology. When the processor 30 detects that the voltage of the connection point 207 equals to the low level voltage, the processor 30 determines that the earphone is inserted into the electronic device 100.

If the earphone detecting unit 40 detects that there is no earphone inserted into the electronic device 100, the earphone detecting unit 40 generates a digital-high voltage, thus, the voltage of the connection point 207 equals to the digital-high voltage, the processor 30 determines that there is no earphone is inserted into the electronic device 100.

The filter capacitor 206 filters the audio signals generated by the audio processing unit 10, to make sure that the voltage of the audio signals input into the base of the transistor 205 is always lower than a preset value, thus to ensure the transistor 205 is always turned on. In this embodiment, the voltage provided to the emitter of the transistor 205 by the voltage port VCC is 3.3V, the preset value of the voltage is 2.6V. Because the transistor 205 is always turned on, the collector of the transistor 205 obtains a digital-high voltage from the voltage port VCC via the transistor 205, and always outputs the digital-high voltage. Therefore, the voltage of the connection point 207 is just determined by the earphone detecting unit 40. By employing the filter capacitor 206, the voltage of the audio signals input into the base of the transistor 205 is always lower than the preset value, and the transistor 205 cannot be turned off. Thus to prevent the voltage of the connection point 207 becomes the digital-low voltage via the resistor 203 due to the transistor 205 is turned off. Therefore, it can prevent the processor 30 determines that there is an earphone is inserted into the electronic device 100 caused by the voltage of the audio signals outputted by the audio signal processing unit 10 is higher than the preset value by mistake, not by the earphone is inserted into the electronic device 100.

The embodiments shown and described above are only examples. Many further details are often found in the art. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An electronic device comprising:

an audio processing unit to generate audio signals;

an audio output circuit electrically connected to the audio processing unit to output the audio signals generated by the audio processing unit;

a processor electrically connected to the audio output circuit; and an earphone detecting unit electrically connected to the audio output circuit and the processor, wherein the earphone detecting unit is configured to detect whether an earphone is inserted into the electronic device; if the earphone is inserted into the electronic device, the earphone detecting unit outputs a digital-low voltage to the processor; if there is no earphone inserted into the electronic device, the earphone detecting unit outputs a digital-high voltage to the processor; the processor determines that an earphone is inserted into the electronic device when receiving a digital-low voltage, and determines that there is no earphone is inserted into the electronic device when receiving a digital-high voltage;

wherein the audio output circuit comprises a transistor, and a filter capacitor; a base of the transistor is connected to the audio processing unit, an emitter of the transistor is connected to a voltage port, the processor and the earphone detecting unit is electrically connected to a collector of the transistor; a connection node is formed between the collector of the transistor, the processor, and the earphone detecting unit; the filter capacitor is connected between the base of the transistor and the ground, the filter capacitor filters the audio signals generated by the audio processing unit, to ensure that the voltage of the audio signals input into the base of the transistor is always lower than a preset value, thus to ensure the transistor is always turned on.

2. The electronic device of claim 1, wherein the audio output circuit further comprises a first resistor, a second resistor, and a third resistor, one end of the first resistor is electrically connected to the voltage port, another end of the first resistor is connected to the audio processing unit; the second resistor is connected between the audio processing unit and the base of the transistor; the third resistor is connected between the collector of the transistor and the ground.

3. The electronic device of claim 2, wherein the audio output circuit further comprises a diode connected between the second resistor and the transistor, an anode of the diode is connected to the second resistor, and a cathode of the diode is connected to a base of the transistor.

4. The electronic device of claim 1, wherein the voltage provided to the base of the transistor by the voltage port is 3.3V, and the preset value of the voltage is 2.6V.

5. An audio circuit applied in an electronic device, the electronic device comprising an audio processing unit to generate audio signals, a processor, and an earphone detecting unit; if the earphone being inserted into the electronic device, the earphone detecting unit outputting a digital-low voltage to the processor; if there being no earphone inserted into the electronic device, the earphone detecting unit outputting a digital-high voltage to the processor; the processor determining that an earphone is inserted into the electronic device when receiving a digital-low voltage, and determining that there is no earphone is inserted into the electronic device when receiving a digital-high voltage; the audio circuit comprises:

a filter capacitor; and a transistor, a base of the transistor is connected to the audio processing unit, an emitter of the transistor is connected to a voltage port, the processor and the earphone detecting unit is electrically connected to a collector of the transistor, the filter capacitor is connected between the base of the transistor and the ground; the filter capacitor filters the audio signals generated by the audio processing unit, to ensure that the voltage of the audio signals input into the base of the transistor is always lower than a preset value, thus to ensure the transistor is always turned on.

6. The audio output circuit of claim 5, wherein the audio output circuit further comprises a first resistor, a second resistor, and a third resistor, one end of the first resistor is electrically connected to the voltage port, another end of the first resistor is connected to the audio processing unit; the second resistor is connected between the audio processing unit and the base of the transistor; the third resistor is connected between the collector of the transistor and the ground.

7. The audio output circuit of claim 6, wherein the audio output circuit further comprises a diode connected between the second resistor and the transistor, an anode of the diode is connected to the second resistor, and a cathode of the diode is connected to a base of the transistor.

8. The audio output circuit of claim 5, wherein the voltage provided to the base of the transistor by the voltage port is 3.3V, and the preset value of the voltage is 2.6V.

* * * * *